United States Patent [19]

Blackwood

[11] 4,132,567

[45] Jan. 2, 1979

[54] APPARATUS FOR AND METHOD OF CLEANING AND REMOVING STATIC CHARGES FROM SUBSTRATES

[75] Inventor: Robert S. Blackwood, Chanhassen, Minn.

[73] Assignee: FSI Corporation, Chaska, Minn.

[21] Appl. No.: 841,656

[22] Filed: Oct. 13, 1977

[51] Int. Cl.[2] ..... B08B 3/02; B08B 3/10; B08B 5/00; B08B 6/00

[52] U.S. Cl. ..... 134/1; 134/18; 134/21; 134/25 A; 134/30; 134/33; 134/37; 134/102; 134/153; 134/200

[58] Field of Search ..... 134/1, 18, 21, 25 A, 134/30, 33, 37, 57 R, 102, 153, 157, 200; 34/1

[56] References Cited

U.S. PATENT DOCUMENTS

| | | | |
|---|---|---|---|
| 3,071,497 | 1/1963 | Hinson | 134/1 |
| 3,668,008 | 6/1972 | Severynse | 134/1 |
| 3,868,271 | 2/1975 | Poley et al. | 134/1 |
| 3,990,462 | 11/1976 | Elftmann et al. | 134/102 |
| 3,991,479 | 11/1976 | Dionne | 34/1 |
| 4,027,686 | 6/1977 | Shortes et al. | 134/30 X |

*Primary Examiner*—Marc L. Caroff
*Attorney, Agent, or Firm*—H. Dale Palmatier

[57] ABSTRACT

Wafers are cleaned in the manufacture of integrated circuits by revolving the wafers successively through a spray of deionized water and drying nitrogen gas in a closed chamber, and introducing ionized nitrogen gas into the closed chamber to eliminate static electric charge on the wafers. The ionized nitrogen gas is generated by passing nitrogen gas through nozzles having electrodes therein maintained at a high ionizing voltage.

6 Claims, 5 Drawing Figures

FIG. 1
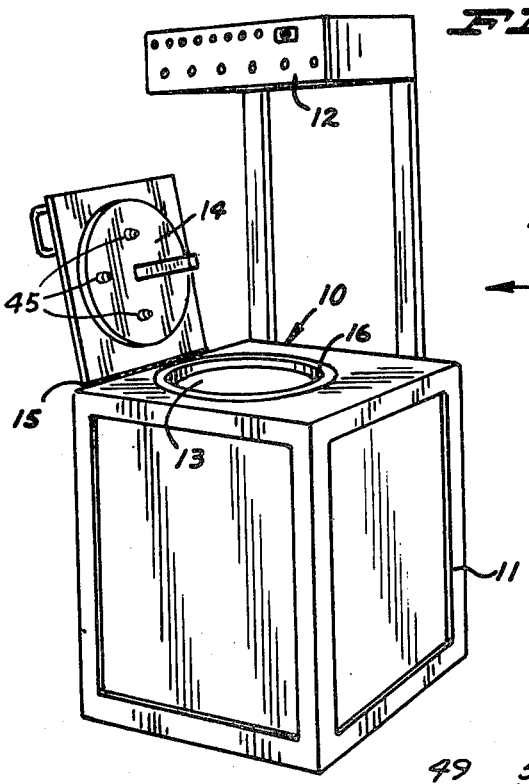
FIG. 4
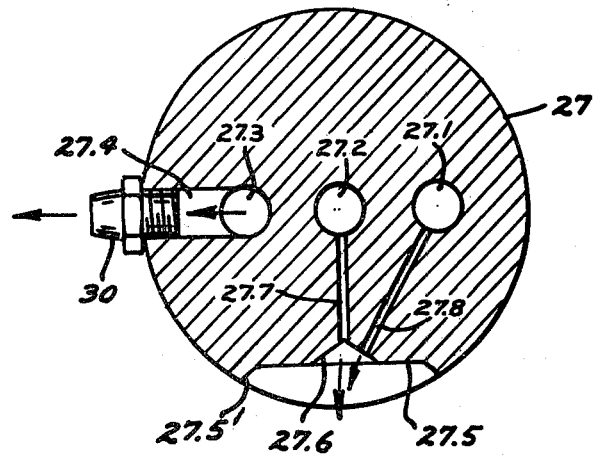
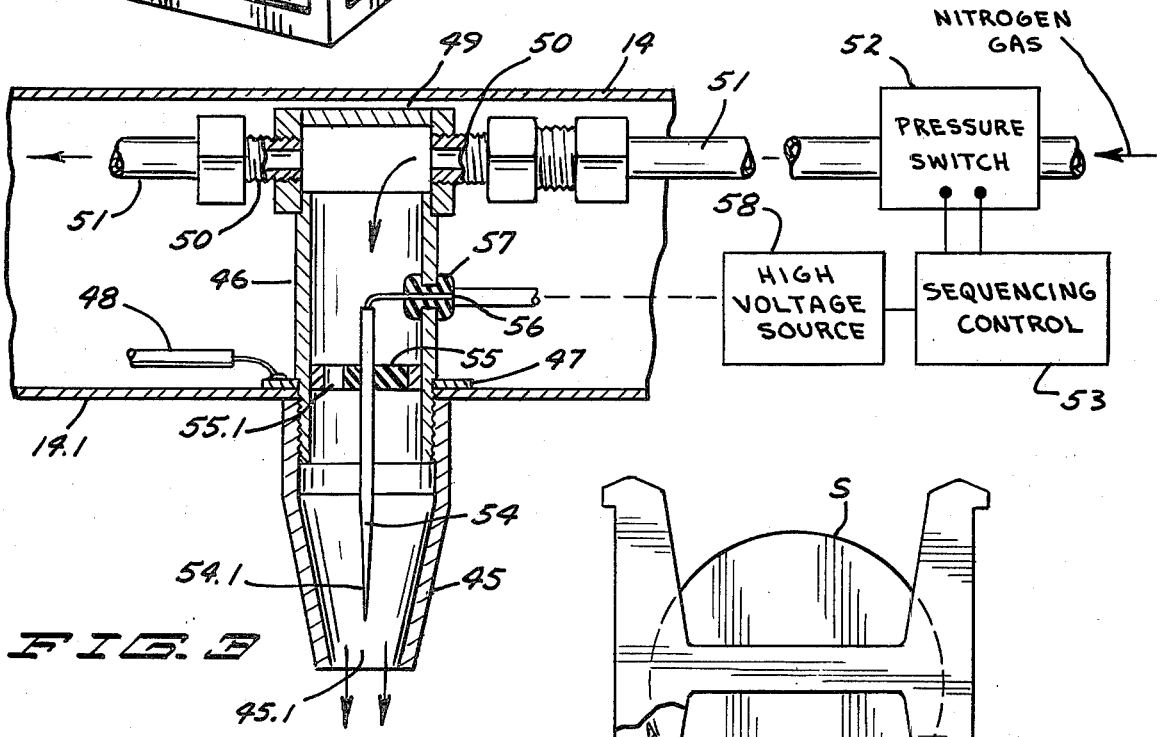
FIG. 3
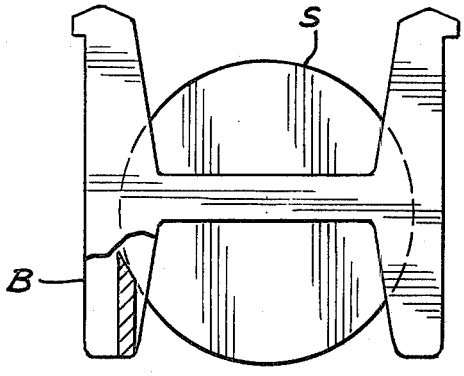
FIG. 5

APPARATUS FOR AND METHOD OF CLEANING AND REMOVING STATIC CHARGES FROM SUBSTRATES

This invention relates to apparatus for and method of cleaning and removing static charges from substrates during the processing thereof.

BACKGROUND OF THE INVENTION

In the production of integrated circuits, the wafers or substrates from which the chips are cut, are processed through multiple steps. The base material for the substrates or wafers may be silicon, glass, or ceramic materials of various sorts, or other similar materials of very thin wafer-like configuration. The basic substrate is subjected to coating, etching and cleaning processes, and it is extremely important that the wafers or substrates be maintained in extremely clean condition during the processing of them.

The wafers or substrates are subjected to an intense washing or rinsing with deionized water, and the atmosphere in which such wafers are cleaned is also controlled and usually consists of nitrogen as to be extremely inert. During the drying stage, the substrates, being confined in a bowl and carried in trays, are revolved at speeds in the range of 1,000 to 1,200 rpm. The nitrogen gas is moved through the bowl at this time so that all of the contaminating particles which may have previously been present are carried away and removed from the environment of the substrates so that such particles will not again attach themselves to the substrates. A typical machine for the purpose of rinsing and drying such substrates is illustrated in U.S. Pat. No. 3,990,462.

SUMMARY OF THE INVENTION

As a result of the present invention, the substrates, which are exceedingly clean as described above, will continue to be clean as they are extracted from the bowl in which they have been confined and from the turntable on which they are carried as they are revolved.

It has been determined that after the substrates and wafers and the trays or carriers therefor have been thoroughly cleaned and dried as described, such substrates, wafers and carriers will carry a very significant static charge. It is believed that the static charge carried by the substrates and wafers and carriers is produced by the high speed revolving of these parts in the dry nitrogen atmosphere.

The presence of the static charge is verified by utilizing a proximity meter as soon as the cover of the bowl is opened upon completion of the rinsing and drying cycles. It has been determined that the static charge on the surfaces of the substrates or wafers and carriers in the bowl may be as much as 30,000 volts, and it is not at all unusual that the static charge on the surfaces of the substrates, wafers and carriers in the bowl be in the range of 20,000 volts at the time the cover is opened.

The effect of the existence of the static charge on the surfaces of the substrates and wafers is that, as the cover of the bowl is opened for the purpose of removing the carriers and the substrates or wafers carried thereby, the high static charge acts to draw many charged particles from the air or atmosphere in the vicinity of the rinser-dryer machine. The effect of such drawing of particles from the air in the vicinity of the rinser-dryer machine is to cause collection of such particles on the charged surfaces of the substrates or wafers with the effect that the substrates or wafers, which had been exceedingly clean immediately prior to opening the cover of the bowl, are again contaminated by miscellaneous particles of various origins.

It has been determined that, with a static charge of approximately 10,000 volts on the surfaces of the wafers within the chamber, particles of approximately 100 microns in size, may be drawn from the air in the vicinity of the bowl from a distance of ten feet away. It will therefore be readily understood that there is a significant propensity for the collection of contaminating particles on the recently cleaned substrates or wafers simply due to the existence of static charges on the surfaces of such substrates or wafers whenever the cover of the rinser-dryer machine is opened for the removal of the cleaned substrates or wafers.

The present invention relates to the identification of the reasons for the contaminating of the wafers or substrates as soon as the bowl cover is opened, and also accomplishes the removal of the static charge from the surfaces of the substrates and wafers and carriers and other parts within the chamber so that such contaminating particles will not be drawn into the chamber. The substrates and wafers which are the work product of the process will thereby remain in exceedingly clean condition and will not be contaminated by reason of such particles.

In order to accomplish the removal of such static charges, ionized nitrogen gas is introduced into the chamber of the bowl during the continuation of the rinsing and drying cycles. A plurality of gas nozzles are fitted onto the inner side of the cover of the washer chamber through which nitrogen gas is introduced into the chamber all through the rinsing and drying cycles. This nitrogen gas being introduced is in addition to the heated nitrogen gas introduced through the conventional central spray post and nozzle orifices to produce the drying effect during the drying phase of the operation. Each of the gas nozzles through which the additional nitrogen gas is introduced into the chamber, carries a needle-like pointed electrode which has an ionizing high voltage applied to it during the drying phase of the operational cycle. The presence of this high voltage ionizing charge on the electrode ionizes the nitrogen gas being introduced and the static charges on the surfaces of the wafers, substrates, carriers and other equipment in the bowl is eliminated by the time the drying phase has been completed.

It has also been determined that the static charge on the surfaces of the substrates and wafers is substantially at its peak at the completion of the rinsing phases of the operating cycle. Although water is usually considered a conductor for the purpose of carrying away static charges, the water used in the rinser-dryer for purposes of cleaning the wafers and substrates, is deionized water which is an extremely good insulator. The revolving of the substrates and wafers and carriers and other mechanism in the chamber in the atmosphere of air and deionized water in the rinse phase of the cycle is believed to cause the buildup of the static charge.

The force of the water spray in the chamber is adequate to rinse away all of the contaminating particles that may have contaminated the surfaces of the substrates or wafers. It may in some instances be necessary to apply a ionizing gas into the chamber prior to the rinsing phase of the cycle if the adherence of particles to the substrates by reason of static charge is unreasonably high.

The high voltage electrodes must be located immediately adjacent the nozzle outlets for the gas which is being ionized, all of which must be in the rinsing chamber. It is important to continue the introduction of nitrogen gas through these nozzles during the rinsing phases of the operation as well as during the drying phases of the cycle so that there will be no accumulation of rinsing water or moisture in the nozzles where the ionizing of the nitrogen gas is to occur.

In order to assure that an adequate amount of nitrogen gas is flowing so as to prevent entry of water spray into the nozzles, the pressure of the nitrogen gas being applied to the nozzle is continuously sensed so that if there is sufficient nitrogen gas pressure sensed, the rinsing phase of the operational cycle of the machine will be allowed to commence.

BRIEF DESCRIPTION OF THE DRAWINGS

FIG. 1 is a perspective view of this type of machine.

FIG. 3 is an enlarged detail section view through a portion of the cover of the machine and illustrating in detail one of the nitrogen gas ionizing nozzles.

FIG. 4 is a detail section view taken at 4—4 in FIG. 2.

FIG. 5 is an end elevation view, partly broken away to illustrate detail in section, and illustrating a basket or carrier containing a number of the wafers or substrates.

DETAILED SPECIFICATION

Figure 2:
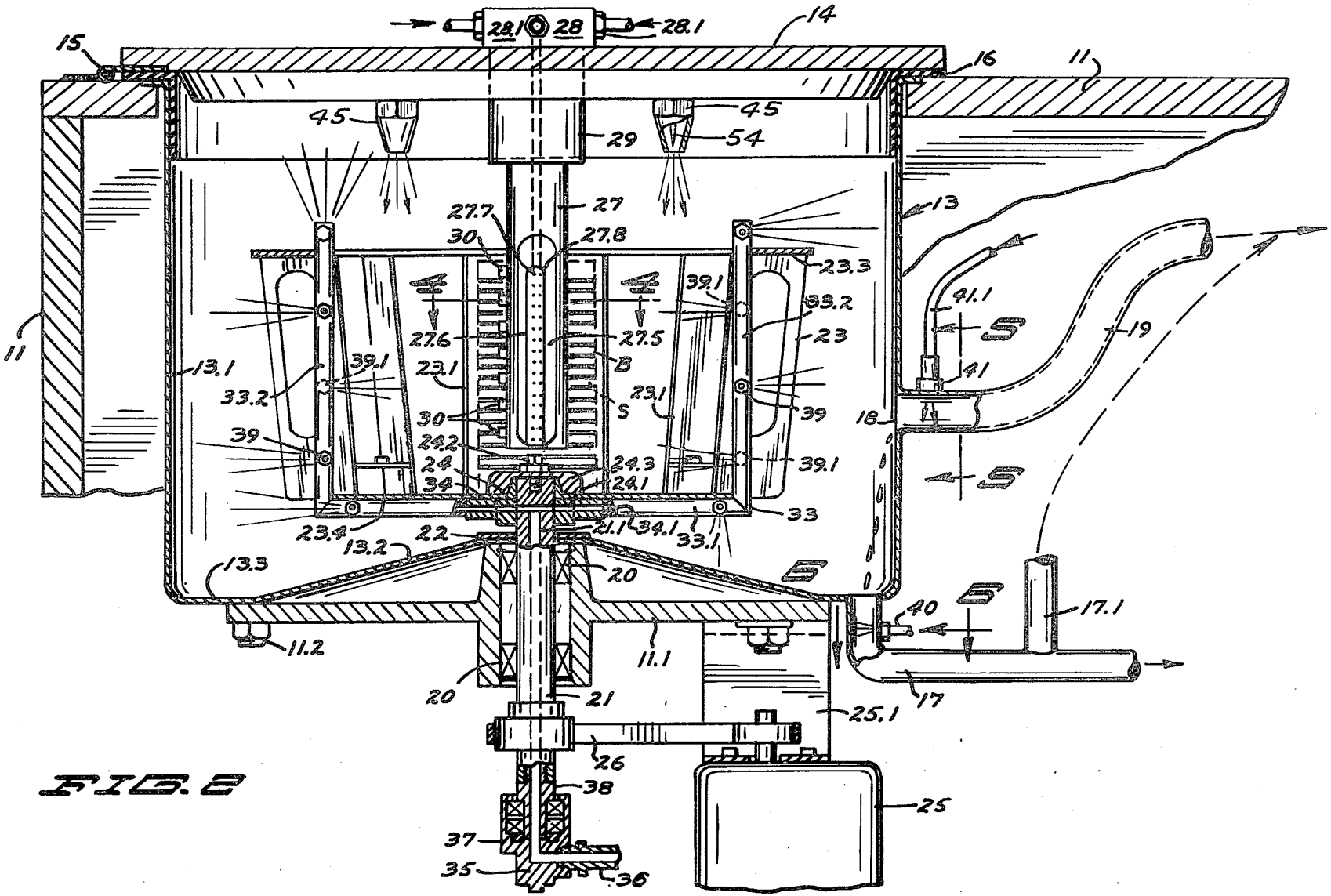
FIG. 2 is an enlarged detail section view of the rinser dryer with the cover closed and showing the relative operational orientation of the nozzles.

One form of the invention is shown in the drawings and is described herein. The substrate etching and stripping apparatus is indicated in general by numeral 10 and is mounted in and carried by a housing 11 having a suitable control panel 12 including various circuitry for automatically sequencing various portions of the cycle of operation. The apparatus includes a circular bowl 13 in which the stripping and etching takes place, and the bowl 13 has a top and cover 14. The cover 14 has a mounting hinge 15 connected to the housing and frame 11, and the cover fits tightly with a peripheral gasket 16 at the upper marginal edge of the bowl 13. A suitable latch or clamp is provided for holding the cover 14 in its closed condition.

The bowl 13 is constructed of a material as to be resistive to the various acids such as sulfuric acid and hydrofluoric acid which may be used in the various etching and stripping and cleaning processes. Typically, bowl 13 may be formed of stainless steel.

The bowl 13 has upright and substantially cylindrical sidewalls 13.1, a bottom wall 13.2 which has an overall convex shape when viewed from the interior of the bowl so as to define a sump area 13.3 around the lower periphery. A drainpipe 17 is attached to the bottom of the bowl 13 at the sump to drain away the liquids collected in the sump.

The bowl 13 also has a vent opening 18 located in a position spaced well above the bottom sump area of the bowl and a gas exhaust duct 19 connects the vent 18 to a central exhaust system drawing a small vacuum in the interior of the bowl when operating. The vacuum may be relatively small, such as one inch of water.

A frame plate 11.1 which is carried by the frame and housing 11 has the bowl mounted thereon and fastened thereto by fitted studs 11.2. Bearings 20 on the frame plate 11.1 mount a rotary drive shaft 21 which extends upwardly through an opening in the bottom wall 13.2 of the bowl and through a seal or bushing 22 mounted on the bottom wall of the bowl. The shaft 21 carries a turntable or rotor 23 in the bowl 13 for the purpose of carrying the substrates which may be of any of a number of materials such as silicon, glass, ceramic, etc. The substrates are indicated by letter S and are illustrated diagrammatically in dotted lines and are carried on the turntable 23 in suitable baskets or carriers B which hold the substrates by their edges and maintain the substrates in spaced relation with each other so that moisture and gas may easily pass between adjacent substrates. Each of the plastic carriers or baskets B is confined in a separate compartment 23.1 of the turntable in such a position that the several substrates are substantially lying in planes normal to the rotation axis of the shaft 21 and turntable 23. Therefore, sprays which are directed outwardly from the central area of the turntable 23 will easily pass between the substrates S. The substrates are thereby whirled with the turntable while the substrates are sprayed with water from spray post 27.

The compartments 23.1 of the turntable 23 are tipped outwardly slightly, and one principal reason of this tipping is to facilitate ready and easy loading of the baskets and substrates onto the turntable. The turntable 23 has a bottom circular panel 23.4 to which the compartments 23.1 are affixed, and an annular or ring shaped plate 23.3 at the top of the compartment. The center or central area of the turntable 23 is entirely open.

The bottom plate 23.4 of the turntable rests upon a supporting hub 24 which is affixed on shaft 21, and the bottom panel 23.4 is held in place by a clamping hub 24.1 which is secured onto the end of the shaft 21 by a cap screw 24.2.

It will be understood that the turntable 23 may have any of a number of mounting compartments 23.1 for the substrate baskets B and that the turntable 23 should be loaded symmetrically when used. In this particular turntable 23 as illustrated, there are six compartments 23.1 for the substrate baskets, but in other turntables there may be four such compartments, or in some instances, eight compartments or more.

The shaft 21 is driven from motor 25 which is suspended from the frame plate 11.1 on a bracket 25.1. The motor drives through a belt and pulley assembly 26 to the shaft 21 so that the motor may be maintained in offset relation and non-aligned relation with respect to the shaft 21.

A spray post 27 is suspended from the cover 14 of the bowl 13, and protrudes through the cover 14 and connects to a distribution head 28 to which the fluid connections are made. A collar 29 at the interior of cover 14 retains the spray post in position and serves to pull the post 27 tightly against the head 28. Spray post 27, as seen in FIG. 4, has three separate passages 27.1, 27.2 and 27.3 extending longitudinally therethrough. The post 27 forms a manifold for supplying various fluids to the spray nozzles and orifices.

In the form illustrated, the passage 27.1 is principally for delivering etching or stripping acids such as sulfuric acid or other acids previously mentioned. The passage 27.1 is connected to a valve which alternately will direct acid or rinsing water, preferably deionized water, through the passage.

Passage 27.2 is connected through the head 28 to a source of gas, preferably gaseous nitrogen, or in some instances simply air which is delivered under pressure.

The passage 27.3 delivers rinsing water, preferably deionized water, in order to obtain the maximum cleansing.

A series of nozzle heads 30 are supplied by ducts 27.4 which communicate with the rinsing water passage 27.3.

The spray post 27 also has an enlarged recess 27.5 adjacent the fluid passages 27.1 and 27.2, and extending substantially the full length of the spray post.

At the bottom of the recess 27.5, there is a substantially V-shaped groove 27.6. A plurality of ducts 27.7 and 27.8 communicate between the groove 27.6 and the passages 27.2 and 27.1, respectively.

The head 28 is connected through fittings 28.1 to various connecting lines and hoses which supply acid, air, nitrogen gas and deionized water under pressure to the post 27.

A pair of rotating manifold pipes 33 are affixed to the rotating turntable 23, and are arranged opposite each other, across a diameter. The inner ends 33.1 of the pipes extend inwardly directly toward the rotation axis of the turntable 23, and are securely affixed into a ring-shaped rigid mounting 34 which has water carrying ports 34.1 communicating with the interior of the pipes 33. The mounting ring 34 surrounds the mounting hub 24 and is sealed thereto. The mounting hub 24 also has diametrically arranged internal water carrying passages 24.1 for supplying water to the pipes 33.

Rinse water is supplied to the hub 24 from longitudinally extending passages 21.1 in the drive shaft 21. A stationary fitting 35 at the end of the shaft 21 is connected to a water supply pipe 36. The stationary fitting 35 is connected through a seal 37 to a revolving fitting 38 threaded into the end of shaft 21, thus facilitating supplying high pressure water into and through the shaft 21 for the manifold pipes 33.

It will be noted that the outer ends 33.2 of the pipes extend upwardly through the turntable 23 at diametrically opposite locations, and between adjacent basket carrying compartments 23.1. The outer ends 33.2 of the pipes are fitted with a plurality of spray nozzles 39, which are variously oriented so that all portions of the cylindrical sidewall 13.1, and the bottom wall 13.2 and the top 14 are intensely sprayed and washed free of any acid residue.

The horizontal inner portions 33.1 also have nozzles 39 for intensely scrubbing all portions of the bottom wall and sump of the bowl.

Certain of the nozzles 39.1 on the manifold pipe 33 direct their fan-shaped sprays inwardly toward and against the spray post 27.

An additional rinse water pipe 40 is connected into the drain 17, immediately adjacent the connection of the drain 17 to the sump of the bowl 13.

The drain 17 is also provided with an exhaust duct 17.1 through which exhaust air or gases may be drawn into the exhaust system along with gases from the duct 19.

The nozzle 41 is supplied through a pipe 41.1 so as to produce a flat spray in the shape of a transverse curtain across the duct 19 to absorb all of the acid particles that may be borne in the air or gas.

It will be understood that suitable valving is provided to start and stop the supply of water through the pipes 41.1 and 40, and of course the rinse water is stopped and started by suitable valving controlling flow through the pipe fittings 35 and 36 to the manifold pipe 33, and also through the water passage 27.3 in the spray post 27. Suitable valving is also provided for controlling a flow of air or gas through the passage 27.2 of the spray post 27; and additional valving is provided for alternately directing acid and water through the passage 27.1 to be sprayed and atomized into the bowl from the orifice or small duct 28. Suitable valving is also provided so that gaseous nitrogen can be blown through the solution lines and passages 27.1 to completely purge the solution from these passages and prevent any subsequent dripping of solution in the bowl after the cycle has been completed.

The drying nitrogen gas is introduced through passage 27.2 after the spraying with water has been completed. While the drying nitrogen is being introduced, the substrates are whirled on the turntable or rotor at a significantly higher rate of speed than while being sprayed.

As an important part of the present invention, the bowl 13 has a plurality of stainless steel gas nozzles 45 mounted on the inner side of the cover 14. The nozzles 45 are all substantially the same, one of which is illustrated in detail in FIG. 3.

The nozzle 45 is threaded onto the lower end of a nipple or fitting 46 which protrudes downwardly through an opening in the lower plate 14.1 of the cover. The nozzle 45 together with the fitting 46 clamp the panel 14.1 of the cover therebetween so as to securely affix the nozzle in stationary position on the cover. A suitable washer is clamped by the fitting 46 onto the panel 14 and the washer 47 is connected to a ground wire 48.

The nipple 46 has a crosshead 49 into which threaded fittings 50 extend for connection to a manifold line or pipes 51 through which nitrogen gas is supplied. The manifold pipe 51 has a pressure switch 52 continuously sensing the pressure of the nitrogen gas in the line. Any change in the pressure of the gas in the line causes a reaction in the sequencing controls 53, which is a part of the control mechanism 12, as to shut down the turntable and drying operation.

A needle-shaped high voltage electrode 54 is located within the nozzle 45 and oriented to extend longitudinally thereof with the sharpened tip end 54.1 disposed immediately adjacent the gas discharging opening 45.1 of the nozzle.

The electrode 54 may be mounted in the nozzle in any suitable way, and, as illustrated, the electrode is carried upon an insulating mounting 55 which is affixed to the inner periphery of fitting 46. The mounting 55 may be substantially spider-shaped and is necessarily provided with suitable openings 55.1 as to allow flow of nitrogen gas therethrough in an adequate quantity as to supply the requirements at the discharge opening 45.1. The high voltage electrode 54 is connected by a high voltage wire 56 which protrudes outwardly through the side of nipple fitting 46 in an insulator 57 provided therein. The high voltage wire 56 is connected to a high voltage source 58 for supplying ionizing voltage to the electrode 54 for the purpose of ionizing the nitrogen gas being discharged through the nozzle.

The present invention contemplates the introduction of the ionized nitrogen gas into the bowl 13 at least during the drying cycle of the machine and in some instances it may be desirable to introduce the ionized nitrogen gas into the bowl during the rinsing cycle as well and if necessary, the ionized nitrogen gas may be introduced into the bowl prior to the rinsing cycle.

Whereas it is normally considered that water is a good conductor of electricity and electrical charges, the deionized water used in the rinsing process of this machine for cleaning the substrates or wafers, is a non-conductor and the ionized nitrogen gas introduced through the nozzles 45, in addition to the heated nitrogen gas introduced into the chamber from the spray post 27, prevents the buildup of any significant static charge on the wafers or carriers or trays during the rinsing and drying phases of the operational cycle.

Ordinarily, the most significant static charge on the surfaces of the substrates and wafers occurs during the rinsing phases and at about the completion of the rinsing phases of the operating cycle. The introduction of the ionized nitrogen gas through the nozzles 45 at this time minimizes the buildup of this static charge during the rinsing cycle. Any charge that is built up during the rinsing cycle is dissipated by the continued introduction of the ionized nitrogen gas during the drying cycle of the machine at which time the deionized water is shut off and only the heated nitrogen gas is being introduced through the spray nozzle, along with the additional non-heated but ionized nitrogen gas introduced through the nozzles 45.

In most instances, the force of the water spray from the spray post 27 and from the nozzles 39 is adequate to rinse away all of the contaminating particles that may have contaminated the surfaces of the substrates or wafers. If, in some instances, the water spray is not adequate to rinse away all of the contaminating particles, it may be necessary to introduce the ionized nitrogen gas into the chamber prior to the rinsing cycle so as to reduce the static charges and thereby make it possible for the water spray from the nozzles 39 and from the spray post 27 to rinse away all of the particles on the substrates or wafers.

When the operating cycle is completed, the substrates and wafers carried in the baskets or carriers B are completely free of contaminating particles and all of the interior of the bowl 13 is also free of such particles which have been carried away by changes of the atmosphere and by the flowing nitrogen gas and by the deionized water which has been entirely removed at the end of the drying cycle through the drain 17.

It will be seen that I have provided for the adequate cleaning of the wafers or substrates by eliminating the static charges therefrom and also provided for the continuation of the extremely clean condition of these wafers or substrates by removing the static charge therefrom prior to the time when the cover 14 is opened for removing the carriers B and the substrates S from the bowl 13.

What is claimed is:

1. A rinser-dryer for cleaning substrates and wafers held in plastic carriers in the production of integrated circuits, comprising a bowl having a cover that opens and closes and a drain and atmosphere exhaust means, a turntable in the bowl to removably mount such carriers, and means to revolve the turntable, means to successively introduce deionized rinsing water and nitrogen gas into the bowl, at least a portion of the gas being for drying the substrates, wafers, and carriers in the bowl, and means for ionizing a portion of the gas for eliminating static charges on the substrates, wafers and carriers in the bowl.

2. A rinser-dryer for cleaning substrates and wafers held in plastic carriers in the production of integrated circuits, comprising a bowl having a cover that opens and closes and a drain and atmosphere exhaust means, a turntable in the bowl to removably mount such carriers, and means to revolve the turntable, means to successively introduce deionized rinsing water and drying gas into the bowl, and means for introducing ionized nitrogen gas into the bowl for eliminating static charges on the substrates, wafers and carriers in the bowl, and including a plurality of stationary nozzles adjacent an inner surface of the bowl and having a discharge opening confronting the interior of the bowl, conduit means supplying nitrogen gas to the nozzles, and a plurality of electrodes each within a respective nozzle and extending toward the discharge opening thereof, and a high voltage means connected to the electrode to ionize the nitrogen gas flowing through the nozzles.

3. The rinser-dryer according to claim 2 and including means sensing gas pressure in the conduit means supplying nitrogen gas to the nozzles.

4. The rinser-dryer according to claim 2 and the electrode having a needle-like shape and a pointed end adjacent the discharge opening of the nozzle.

5. In a rinser-dryer for cleaning substrates and wafers held in plastic carriers in the production of integrated circuits, including a closed bowl with an openable cover confining a turntable which mounts such carriers and means to revolve the turntable and thereby whirl such substrates and wafers, the bowl having a drain and atmosphere exhausting means, means for introducing deionized rinsing water into the bowl to spray and clean the substrates or wafers and for subsequently introducing a drying nitrogen gas into the bowl to eliminate moisture in the bowl, the improvement comprising a metal nozzle on an interior surface of the bowl and connected to a means for supplying nitrogen gas under pressure and introducing the nitrogen gas into the bowl, and a high voltage electrode in the nozzle and connected to a high voltage means for ionizing the nitrogen gas directed through the nozzle into the bowl for eliminating the static charges on the substrates or wafers and carriers in the bowl.

6. A process of cleaning substrates or wafers in a closed bowl from which the atmosphere is being exhausted and liquids drained, comprising whirling the substrates while spraying the substrates with deionized water, introducing drying nitrogen gas into the bowl after such spraying has been terminated and simultaneously whirling the substrates at a significantly higher rate of speed than when being sprayed, and producing a flow of ionized nitrogen gas in the bowl after termination of water spraying and while the drying nitrogen gas is being introduced.

* * * * *